United States Patent [19]

Wacha et al.

[11] Patent Number: 4,529,328

[45] Date of Patent: Jul. 16, 1985

[54] PROJECTION-RETRACTION MECHANISM FOR A WRITING INSTRUMENT

[75] Inventors: Martin E. Wacha, Beloit; Jerry W. Digney, Janesville, both of Wis.

[73] Assignee: The Parker Pen Company, Janesville, Wis.

[21] Appl. No.: 529,338

[22] Filed: Sep. 6, 1983

[51] Int. Cl.[3] ..... B43K 23/00; B43K 7/12

[52] U.S. Cl. ..... 401/117; 401/91; 401/116

[58] Field of Search ..... 401/117, 116, 102, 91

[56] References Cited

U.S. PATENT DOCUMENTS

| | | | |
|---|---|---|---|
| 866,148 | 9/1907 | Levingston | 401/91 |
| 928,312 | 7/1909 | Lloyd | 401/117 |
| 1,493,833 | 5/1924 | Wade | 401/117 |
| 2,441,280 | 5/1948 | Moore . | |
| 2,603,186 | 7/1952 | Fischer | 401/116 |
| 2,941,511 | 6/1960 | Cieremans | 401/116 |

FOREIGN PATENT DOCUMENTS

| | | | |
|---|---|---|---|
| 6925932 | 11/1969 | China . | |
| 3164 | of 1893 | United Kingdom | 401/91 |

*Primary Examiner*—Steven A. Bratlie

*Attorney, Agent, or Firm*—Edmond T. Patnaude

[57] ABSTRACT

A two-part barrel sleeve includes an internal spring finger which rides in a spiral groove in the combined ink reservoir and barrel of a ball pen, the spiral groove having a detent at its rear end to provide a snap-action as the barrel sleeve is retracted to its rearmost position exposing the writing tip for normal use.

8 Claims, 5 Drawing Figures

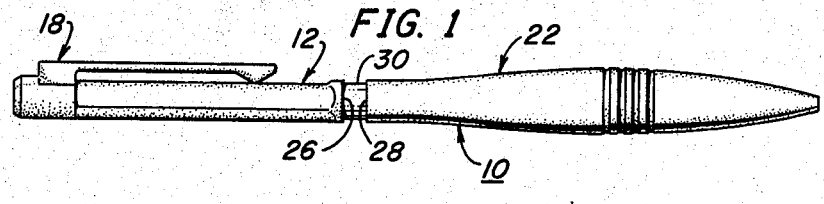
FIG. 1
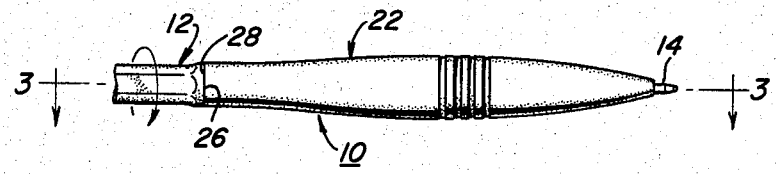
FIG. 2
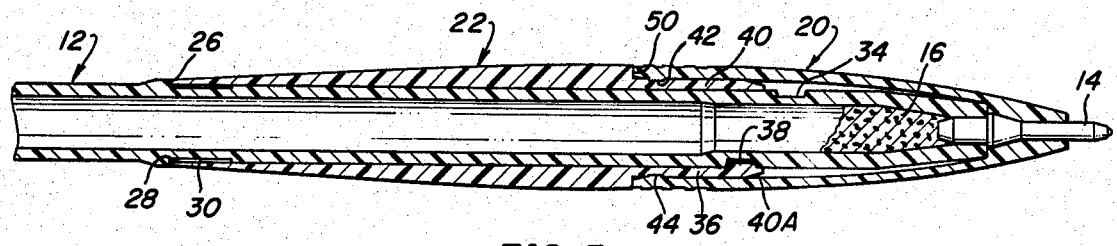
FIG. 3
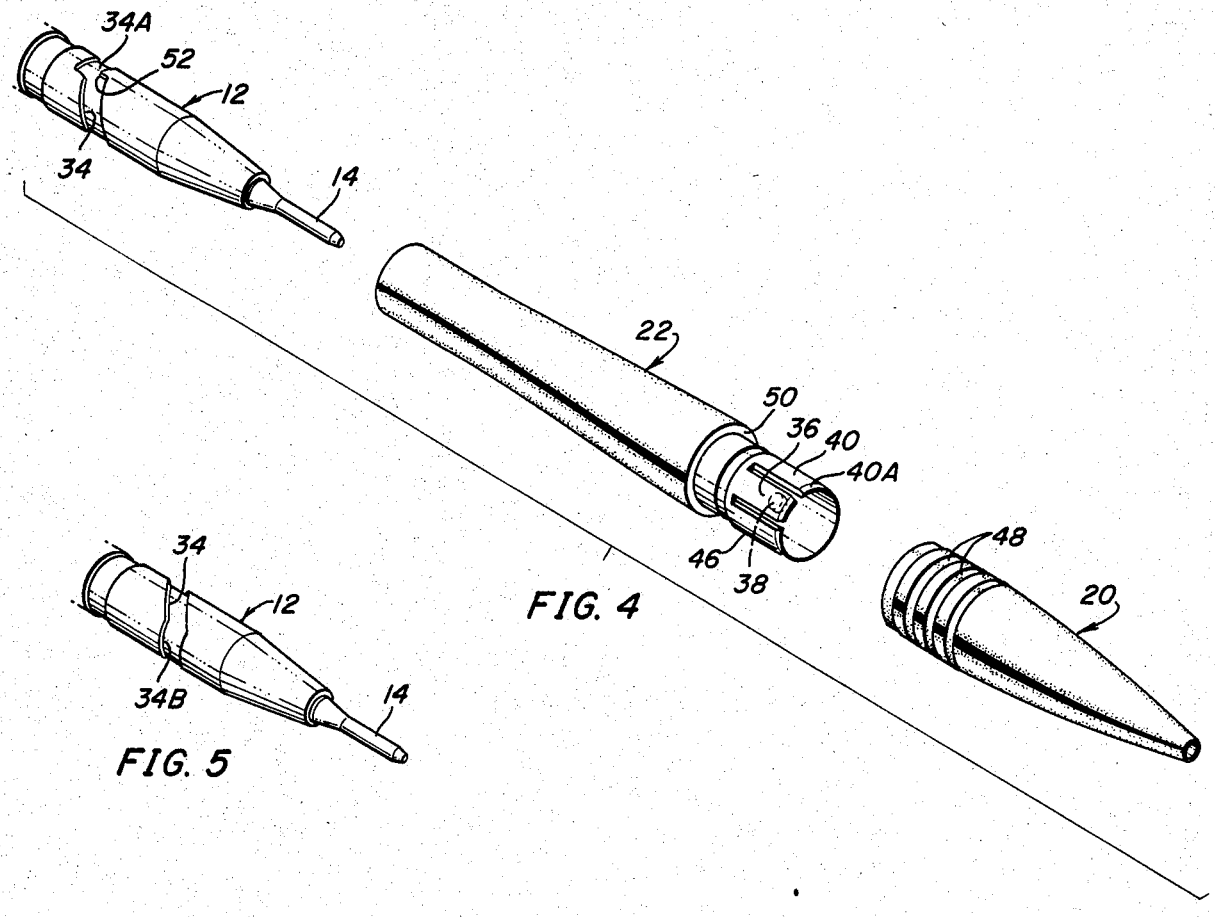
FIG. 4
FIG. 5

PROJECTION-RETRACTION MECHANISM FOR A WRITING INSTRUMENT

The present invention relates in general to writing instruments of the type in which a tubular shroud may be moved between a forward storage postion wherein it covers and protects the writing tip of the instrument, and a rearward retracted position wherein the writing tip is exposed for normal use.

BACKGROUND OF THE INVENTION

It is known in the prior art to threadedly mount a tubular barrel to a writing cartridge located within the barrel so that relative rotation between the writing cartridge and the barrel results in axial displacement of the barrel relative to the cartridge. In that construction the writing tip may be shrouded by the barrel when the writing instrument is not being used. See, for example, U.S. Pat. Nos. 2,441,280 and 2,603,186 for a description of that type of writing instrument. Similarly, it is known to threadedly attach a short, tubular shroud sleeve to the barrel of a writing instrument for the same purpose.

Although these prior art systems have functioned as intended, they have exhibited several characteristics which leave room for improvement. For example, in some cases the threadedly connected parts have not been sufficiently tight to prevent a noticeable amount of axial play between the two parts. In other designs, the parts were complex and expensive to manufacturer while in other cases they were not conducive to use in attractively styled writing instruments.

It would be desirable, therefore, to provide a novel writing instrument of the heretofor mentioned type wherein the projection/retraction mechanism is durable, yet simple in construction and easy to assemble with automated assembly techniques.

SUMMARY OF THE INVENTION

Briefly, there is provided in accordance with the present invention a new and improved writing instrument having a construction which is particularly suited to automated assembly techniques. This instrument includes a ball pen cartridge constituting the barrel of the pen and having a spiral groove near its forward end into which a follower lug on a spring finger carried internally by a two-part tubular shroud assembly is resiliently pressed. The spring finger provides uniform resistance to relative rotation between the barrel and the shroud as the shroud is rotated between the writing and storage positions. A detent step is provided at the rearmost end of the spiral groove so that the shroud snaps into its rearmost position fully exposing the writing tip for normal use. In the rearmost position of the shroud the annular rear end of the shroud abuts a forwardly facing annular stop shoulder on the barrel whereby the shroud is trapped between the stop shoulder and the step in the spiral groove whereby any substantial spurious movement relative to the cartridge is prevented.

Preferably, the shroud consist of two axially aligned sleeves which are snap-fitted together during assembly to the barrel. The rear sleeve includes the spring finger which extends under the front sleeve and is held in operative engagement with the spiral groove by means of a collar on the front sleeve.

In accordance with another feature of a preferred embodiment of the present invention, the annular portion of the barrel disposed just in front of the stop shoulder and which is exposed when the shroud is in its forwardmost position shrouding the writing tip carries visible indicia corresponding to a writing characteristic of the writing instrument such as the size of the ball and the color or type of ink.

The barrel and shroud may be injection molded plastic parts thereby reducing the weight of the writing instrument and enabling the use of attractively styled designs.

GENERAL DESCRIPTION OF THE DRAWINGS

The present invention will be better understood by a reading of the following detailed description taken in connection with the accompanying drawing wherein:

FIG. 1 is a side view of a writing instrument embodying the present invention, the writing tip being shown the shrouded, storage position;

FIG. 2 is a side view of the writing instrument shown in FIG. 1, the writing tip being shown in the exposed, writing position;

FIG. 3 is a cross-sectional view taken along the line 3—3 of FIG. 2;

FIG. 4 is an exploded, perspective view of the forward portion of the writing instrument of FIG. 1; and FIG. 5 is a perspective view of the forward portion of the barrel at a different angle of orientation than that shown in FIG. 4.

DETAILED DESCRIPTION OF A PREFERRED EMBODIMENT OF THE INVENTION

Referring to the drawing, a writing instrument 10 of the ball pen type comprises as its principal elements a tubular barrel 12 having a conventional writing tip 14 fitted into the front and in communication with a supply of liquid ink 16 contained within the barrel 12; a pocket clip member 18 affixed over the rear end of the barrel 12; and a shroud assembly made up of front and rear tubular shroud pieces 20 and 22 snap-fitted together over the forward portion of the barrel 12. As more fully described hereinafter, rotation of the shroud assembly in one direction relative to the barrel 12 causes the shroud assembly to move forward and to shroud or cover the writing tip 14 as shown in FIG. 1. Rotation of the shroud assembly in the opposite direction causes the shroud assembly to move rearwardly on the barrel 12 to the writing position shown in FIG. 3 exposing the writing tip 14. A detent is provided to prevent spurious movement of the shroud from its rearwardmost writing postion during use of the instrument.

Considering the writing instrument 10 in greater detail, the barrel 12 is preferably a molded plastic part which functions as the main body member and also as the ink reservoir. It includes a forwardly facing annular shoulder 26 against which the rear, annular edge 28 at the rear of the shroud piece 22 abuts when the shroud assembly is in its rearwardmost position exposing the tip 14 for normal use. When the shroud assembly is in its forward, shrouding position, a narrow annular band 30 on the barrel 12 is exposed. Preferably the band 30 is color coded or imprinted with some other code identifying the type of ink, the color of the ink and the size or type of writing tip, such for example, as fine, medium or board.

The barrel 12 is provided with a spiral camming groove 34, and the rear shroud piece 22 includes a forwardly extending spring finger 36 having near its distal end a cam follower projection in the form of a button 38 extending into the groove 34. The cam follower projection 38 is held in the groove 34 by means of the front shroud piece which extends over the collar 40 at the front of the rear shroud piece 22. The two shroud pieces 20 and 22 are held in mutually assembled relationship by a narrow, internal annular rib 42 on the piece 20 which, as best shown in FIG. 3 fits into a complimentary annular groove 44 in the collar 40 of the rear shroud piece 22. In addition, a plurality of longitudinally extending ribs 47 are provided on the collar 40 to assure that there is no noticeable relative movement between the shroud pieces.

A plurality of equally spaced annular grooves 48 are provided in the external surface of the front shroud piece 20 to facilitate gripping of the instrument 10 during writing. The rearwardmost groove 48 is bounded on its rear side by a forwardly facing annular shoulder 50 of the rear shroud piece 22. Consequently, the demarcation line between the two shroud pieces is not visually apparent in the assembled writing instrument.

With particular reference to FIG. 4, it may be seen that the rear portion of the groove 34 identified at 34A lies in a plane perpendicular to the longitudinal axis of the barrel 12, and a detent ridge 52 is located between the portion 34A and the spiral portion of the groove 34 to prevent spurious movement of the shroud down over the writing tip during normal use of the instrument. The forward end portion 34B of the groove 34 also lies in a plane perpendicular to the longitudinal axis of the instrument so that a torque must be applied between the barrel 12 and the shroud assembly to unshroud the writing tip.

It may thus be seen that the writing instrument is readily adaptable to automated assembly techniques. After the barrel 12 has been filled with ink and the tip 14 fitted in place, the rear shroud piece may be pushed over the front end of the barrel until the cam follower projection 38 snaps into the groove 34. Then the front shroud piece may be pushed over the front end of the barrel and over the collar until the rib 42 thereon snaps into the groove 44 in the rear shroud piece. The rib is sufficiently thin, and the plastic of which the piece 20 is molded is sufficiently resilient to permit the rib 42 to slide over the forward portion of the collar 40. It may be seen that the front end 40A of the collar 40 is tapered to facilitate movement of the collar 40 into the rear end of the front shroud piece 20 during the assembly operation. Once assembled, the shroud pieces cannot be readily disassembled from one another or from the barrel.

While the present invention has been described in connection with a particular embodiment thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. A writing instrument comprising in combination, a tubular barrel containing a supply of ink, a writing tip affixed to said barrel at one end thereof, and said barrel having a spiral groove in the exterior surface thereof, tubular shroud means through which said barrel extends including:

a plurality of sleeves snap-fitted together in axially aligned relationship over said barrel, and a spring finger having a follower means portion extending into said groove and being an integral part of one of said sleeves, the other one of said sleeves overlying said finger and preventing movement of said follower means portion out of said groove.

2. A writing instrument according to claim 1, comprising a forwardly facing annular stop shoulder on said barrel, said shoulder being positioned to abut the rear end of said tubular shroud means when said follower means portion is positioned at its rearwardmost position in said groove and to be spaced from the rear end of said tubular shroud means when said follower means portion is positioned at its forwardmost position in said groove.

3. A writing instrument according to claim 2 wherein said groove is provided with detent step means to prevent spurious forward movement of said follower means portion from said rearwardmost position.

4. A writing instrument, comprising in combination a tubular barrel containing a supply of ink and having a writing tip at one end, said barrel being rectilinear and having in the extenal surface thereof a spiral groove, tubular shroud positioned over said barrel in coaxial relationship therewith and including:

a rear sleeve and a front sleeve, said sleeves being snap-fitted together in coaxially aligned relationship, a spring finger disposed internally of said tubular shroud intermediate the ends thereof and having a follower extending into said groove, said finger being an integral part of one of said sleeves, and means on the other of said sleeves overlying said finger to hold said follower in said groove, said tubular shroud being dimensioned so that said writing tip extends from the front end of said shroud when said follower is in a rear end portion of said groove, and said writing tip is shrouded by said shroud when said follower is in the front end portion of said groove.

5. A writing instrument according to claim 4 wherein said one of said sleeves has an end portion of reduced external diameter fitted into the adjacent end portion of the other of said sleeves, and said portion of reduced external diameter is provided with angularly spaced, longitudinal slits defining said spring finger therebetween.

6. A writing instrument according to claim 5 wherein said one of said sleeves is provided with an annular groove, and said other of said sleeves is provided with an annular bead which is disposed in said annular groove when said shroud sleeves are in abutting, assembled relationship.

7. A writing instrument according to claim 4 wherein said shroud sleeves are plastic moldings, and said follower is an integral part of said one of said sleeves.

8. A writing instrument according to claim 4 wherein said groove is provided with a detent step between a spiral portion and a rear end portion to deter spurious movement of said follower from said rear end portion of said groove to said spiral portion of said groove.

* * * * *